United States Patent [19]

Dawson

[11] Patent Number: 5,002,072

[45] Date of Patent: Mar. 26, 1991

[54] CIGARETTE MANUFACTURE

[75] Inventor: John Dawson, Coventry, England

[73] Assignee: Molins PLC, London, United Kingdom

[21] Appl. No.: 317,591

[22] Filed: Mar. 1, 1989

[30] Foreign Application Priority Data

Mar. 3, 1988 [GB] United Kingdom ..... 8805103

[51] Int. Cl.[5] ..... A24B 7/14

[52] U.S. Cl. ..... 131/109.1; 73/866; 131/905; 131/906; 131/907; 131/910; 198/500; 198/502.1; 209/536; 209/576; 209/577; 209/578; 209/589

[58] Field of Search ..... 131/908, 905, 906, 907, 131/109.1, 280, 28, 910; 209/536, 535, 576–579, 587, 589; 73/866, 865.9, ; 198/500, 502.1, 810; 378/53, 88

[56] References Cited

U.S. PATENT DOCUMENTS 2,237,254 4/1941 Broekhuysen ..... 209/535
4,212,397 7/1980 Bockelmann ..... 209/576 X
4,262,806 4/1981 Drabs ..... 209/587 X
4,657,144 4/1987 Martin et al. ..... 131/905 X
4,848,590 7/1989 Kelly ..... 209/589 X

*Primary Examiner*—V. Millin
*Assistant Examiner*—Jennifer L. Doyle
*Attorney, Agent, or Firm*—Antonelli, Terry, Stout & Kraus

[57] ABSTRACT

A cigarette making machine includes one or more conveyor bands (12,14,28) or other parts of non-metallic material from which pieces can break off and become entrained in the tobacco, including means (30,42) for detecting such pieces in the tobacco by directing a radiation beam towards the tobacco, and including means 40 for ejecting tobacco or finished cigarettes including such detected pieces, the parts in question being made of a material, or having a material incorporated in then or coated on them, which is either opaque or partially opaque to the detection beam, or which produces a detectable secondary emission detected by the detecting means.

10 Claims, 1 Drawing Sheet

CIGARETTE MANUFACTURE

BACKGROUND OF THE INVENTION

This invention is concerned particularly with the detection of foreign bodies in tobacco used to manufacture cigarettes. It is common practice to provide a magnet arrangement for detecting and removing ferrous metal foreign bodies in cigarette machine hoppers. Non-ferrous metallic particles can be detected in the finished cigarettes, if necessary, in various ways, for example by means an infra-red or other beam of energy which is interrupted by such foreign bodies. It has, however, generally been accepted that non-metallic foreign bodies, such as pieces broken off conveyor bands, cannot readily be detected since they are transparent to infra-red beams or to beams of other frequencies which could be used, on the other hand, it is desirable to be able to detect such foreign bodies as their presence in the finished cigarettes is objectionable and could in some instances constitute a health hazard to the smoker.

SUMMARY OF THE INVENTION

This invention is also applicable to the manufacture of other consumer goods or material such as foods. However, it will for convenience be described with reference to cigarette manufacture.

According to the present invention, non-metallic parts of a cigarette making machine or other consumer goods producing machine which could conceivably have pieces broken off without necessarily having an obvious effect on the operation of the machine (so as to be detectable because of the effect on the operation) are made of a material, or have a material added or included in them, which is either opaque or partially opaque to a detection beam, for example infra-red, or which produces a detectable secondary emission. An example of a secondary emission is visible light which would be emitted if the foreign bodies include zinc sulphide and are irradiated with ultra-violet light.

Detection of foreign bodies may be carried out with respect to finished cigarettes or with respect to the tobacco in a cigarette making machine hopper. In the former case, cigarettes including foreign bodies may be ejected in the same way and possibly at the same point as cigarettes ejected as a consequence of pneumatic inspection of the wrappers. In the latter case, the tobacco may for example slide down a ramp of which a part is pivotally movable so as to deflect tobacco containing a foreign body away from its normal path and into a removable receptacle. Alternatively, foreign bodies may be detected in the tobacco in a part of the machine (e.g. the chimney in a Molins type of cigarette maker) where the tobacco is finely divided but is about to be formed into a cigarette filler stream; in that case a sufficient number of cigarettes may subsequently be automatically ejected to ensure that the cigarette containing the foreign body is ejected.

Other examples of materials which may be applied as a coating or additive for the non-metallic parts of a cigarette machine for the purpose of detection are copper salts. These may be detected by irradiation, for example, by X-rays.

BRIEF DESCRIPTION OF THE DRAWINGS

Examples of apparatus according to this invention are shown in the accompanying drawings. In these drawings.

DESCRIPTION OF THE PREFERRED EMBODIMENTS

Figure 1:
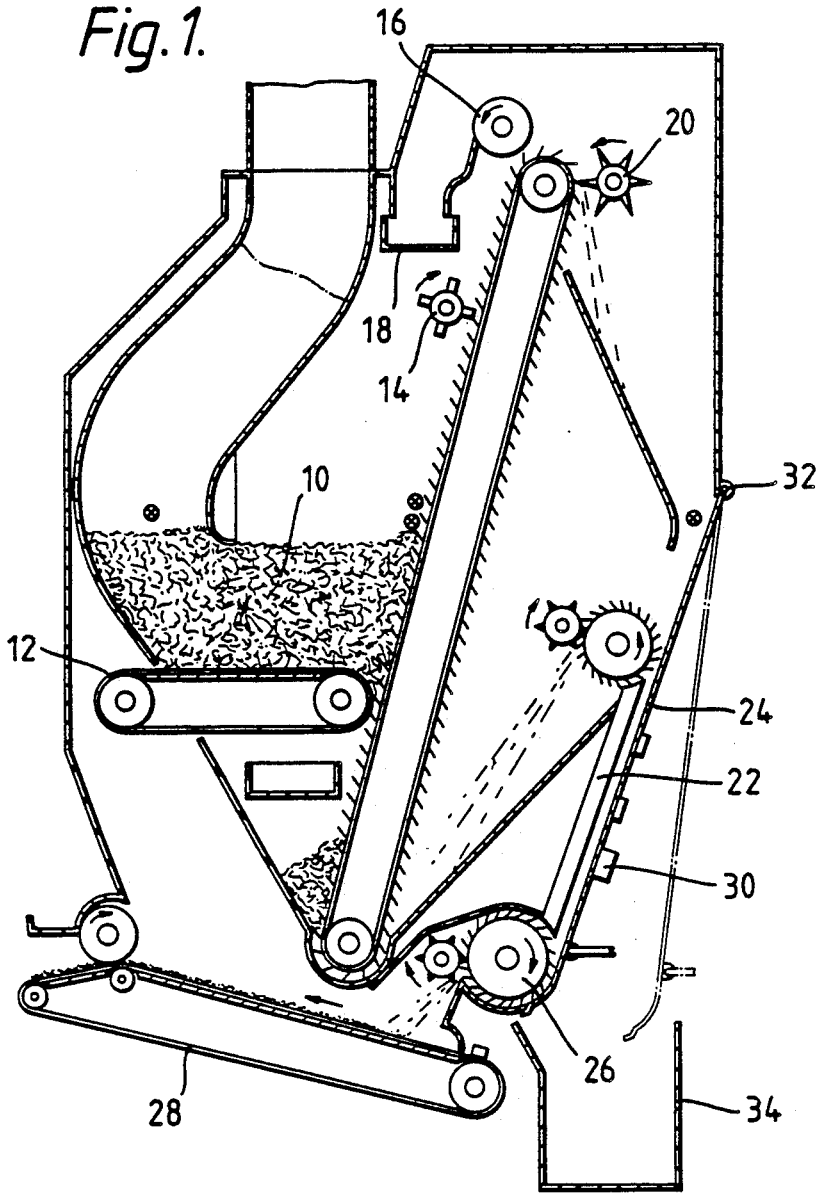
FIG. 1 is a cross-sectional view of a hopper of a cigarette making machine.

FIG. 1 shows a hopper of a cigarette making machine which is fully described in our U.S. Pat. No. 4,330,001. Basically, tobacco 10 is fed by a conveyor band 12 towards a spiked elevator 14 arranged to carry upwards a metered stream of tobacco. A magnet 16 removes ferrous metal foreign bodies and deposits then in a container 18. Tobacco is removed from the elevator 15 by a pinned roller 20 and passes into a narrow channel formed by substantially parallel walls 22 and 24. A carded roller 26 conveys the tobacco from the lower end of the channel and onto a relatively fast conveyor band 28 which feeds the tobacco into the chimney of a cigarette making machine of the type known as the Molins Mark 9 or Mark 10 cigarette making machine.

It will be appreciated that each of the conveyor bands 12, 14 and 28 can be made of a flexible non-metallic material of which small pieces could break off and become entrained in the tobacco. Such foreign bodies in the tobacco, from any one of those bands, may most conveniently be detected in the finished cigarettes in the manner described below with reference to FIG. 2. However, the detection of such foreign bodies may, in principle, be achieved in the hopper itself, at least with respect to foreign bodies emanating from the conveyor bands 12 and 14. For example, a detecting means 30 of any one of the types described above may be situated adjacent to the channel 24, 26 and following the detection of a corresponding foreign body by the detector 30, the entire wall 24 may be automatically swung in a counter clockwise direction about a pivot 32, as shown by the chain dotted outline of the wall 24, so as to deposit the foreign body (together with all the tobacco in the channel) in a collector 34. Alternatively, a smaller part of the wall 24 at or near the lower end thereof may be swung outwards in the manner described so to remove the foreign body with less tobacco.

Figure 2:
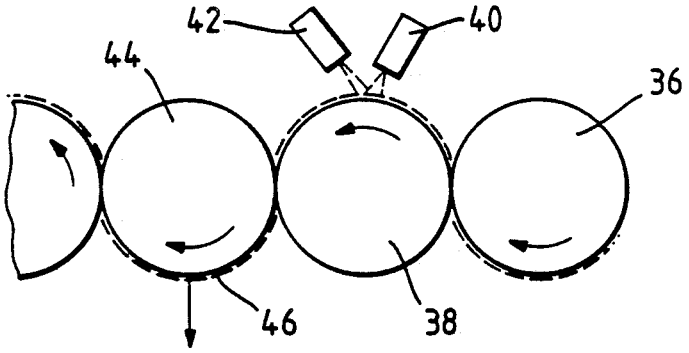
FIG. 2 is a diagramatic front view of a few drums of a filter attachment machine used for the purpose of detecting foreign non-metallic bodies in the finished cigarettes.

FIG. 2 shows some of the drums of a cigarette filter attachment machine. Finished cigarettes (possibly after filters have been attached to them) are conveyed by a drum 36 onto a drum 38 adjacent to which there is a device 40 for irradiating the cigarettes, and a device 42 for detecting secondary emissions produced by non-metallic foreign bodies in the cigarettes in accordance with any one of the examples described above. Cigarettes found to contain foreign bodies are ejected automatically from the next drum 44 at an ejection point 46.

I claim:

1. A cigarette making machine, comprising at least one part made of non-metallic material from which pieces can break off and become entrained in tobacco passing through the machine, means for detecting such pieces in the tobacco by directing a radiation beam towards the tobacco, and means for ejecting tobacco or finished cigarettes including such detected pieces, said part being made of a detectable material, or having a detectable material incorporated therein or coated thereon, which detectable material is either opaque or partially opaque to the detection beam, or which produces a detectable secondary emission detected by the detecting means for discriminating the pieces from the tobacco in the tobacco stream, in which the detectable material comprises or includes zinc sulphide, the detection beam being ultra-violet light so as to cause the zinc sulphide to emit visible light which is detected by detecting means.

2. A cigarette making machine, comprising at least one part made of non-metallic material from which pieces can break off and become entrained in tobacco passing through the machine, means for detecting such pieces in the tobacco by directing a radiation beam towards the tobacco, and means for ejecting tobacco or finished cigarettes including such detected pieces, said part being made of a detectable material, or having a detectable material incorporated therein or coated thereon, which detectable material is either opaque or partially opaque to the detection beam, or which produces a detectable secondary emission detected by the detecting means for discriminating the pieces from the tobacco in the tobacco stream, in which the detectable material comprises or includes copper salts, the detection beam being X-ray radiation.

3. A machine for the manufacture of consumer goods or material, including at least one part made of non-metallic material from which pieces can break off and become entrained in the goods or material, means for detecting such pieces in the goods or material by directing a radiation beam thereto, and including means for ejecting goods or material including such detected pieces, said part being made of a detectable material, or having a detectable material incorporated therein or coated thereon, which detectable material is either opaque or partially opaque to the detection beam, or which produces a detectable secondary emission detected by the detecting means for discriminating the pieces from the goods or material, in which the detectable material comprises or includes zinc sulphide, the detection beam being ultra-violet light so as to cause the zinc sulphide to emit visible light which is detected by the detecting means.

4. A machine for the manufacture of consumer goods or material, including at least one part made of non-metallic material from which pieces can break off and become entrained in the goods or material, means for detecting such pieces in the goods or material by directing a radiation beam thereto, and including means for ejecting goods or material including such detected pieces, said part being made of a detectable material, or having a detectable material incorporated therein or coated thereon, which detectable material is either opaque or partially opaque to the detection beam, or which produces a detectable secondary emission detected by the detecting means for discriminating the pieces from the goods or material, in which the detectable material comprises or includes copper salts, the detection beam being X-ray radiation.

5. A cigarette making machine, comprising: at least one part made of a non-metallic material from which pieces can break off and become entrained in tobacco passing through the machine, said part including a detectable material, in addition to said non-metallic material, which produces a detectable secondary emission when subjected to a radiation beam; detecting means for detecting such pieces in the tobacco by directing a radiation beam towards the tobacco and detecting secondary emission produced from said detectable material; and means for ejecting tobacco or finished cigarettes including such detected pieces.

6. A cigarette making machine, comprising: at least one part made of a non-metallic material from which pieces can break off and become entrained in tobacco passing through the machine, said part being coated with a material which is detectable by said radiation beam; detecting means, which cannot distinguish between tobacco and said non-metallic material but can distinguish between said tobacco and the coating material, for detecting such pieces in the tobacco by directing a radiation beam towards the tobacco; and means for ejecting tobacco or finished cigarettes including such detected pieces.

7. A cigarette making machine, comprising at least one part made of a non-metallic material from which pieces can break off and become entrained in tobacco passing through the machine, said part including a material, in addition to said non-metallic material, which is capable of being discriminated from tobacco when subjected to a radiation beam; detecting means for detecting such pieces in the tobacco by directing a radiation beam towards the tobacco, which detection means cannot distinguish between tobacco and the said non-metallic material but can distinguish between said tobacco and the material included in said part; and means for ejecting tobacco or finished cigarettes including such detected pieces, wherein said radiation beam comprises non-visible radiation.

8. A cigarette making machine according to claim 7, wherein said detectable material is provided as a coating on said part.

9. A cigarette making machine, comprising at least one part made of a non-metallic material from which pieces can break off and become entrained in tobacco passing through the machine, said part including a detectable material which is included in said part solely for the purpose of enabling pieces which break off of said part to be detected by a radiation beam; detecting means for detecting such pieces in the tobacco by directing a radiation beam towards the tobacco, which detecting means cannot distinguish between tobacco and the said non-metallic material, but can distinguish between tobacco and said detectable material; and means for ejecting tobacco or finished cigarettes including such detected pieces.

10. A cigarette making machine according to claim 9, wherein said detectable material is provided as a coating on said part.

* * * * *